US005213336A

United States Patent [19]

Bateman

[11] Patent Number: 5,213,336

[45] Date of Patent: * May 25, 1993

[54] CONTROL DEVICE FOR LINKING PNUEMATICALLY-ACTUATED TARGETS

[76] Inventor: Kyle E. Bateman, P.O. Box 636, Provo, Utah 84603-0636

[ * ] Notice: The portion of the term of this patent subsequent to Aug. 25, 2009 has been disclaimed.

[21] Appl. No.: 688,317

[22] Filed: Apr. 22, 1991

[51] Int. Cl.[5] ..... F41J 7/00

[52] U.S. Cl. ..... 273/406

[58] Field of Search ..... 273/406

[56] References Cited

U.S. PATENT DOCUMENTS 4,501,427 2/1985 Payne ..... 273/406

FOREIGN PATENT DOCUMENTS 1038952 9/1958 Fed. Rep. of Germany ..... 273/406

2480425 10/1981 France ..... 273/406

OTHER PUBLICATIONS

"Pistol Target Mechanism Operated By Compressed Gas" *American Riflemen* Jun. 1967. p. 63.

*Primary Examiner*—William H. Grieb

[57] ABSTRACT

A control device for automatically regulating pneumatically-actuated target systems. When the device receives air pressure at its input, it directs the pressure to actuate one or more targets for an amount of time set in advance by means of a variable flow regulator which is a part of the control device. After the set time has elapsed, the air pressure is routed to return the target(s) to their original pre-actuation positions and to allow air flow to the output of the control device where it can be directed to repeat, as often as desired, the same or similar processes with different sets of targets through means of additional control devices.

4 Claims, 2 Drawing Sheets

CONTROL DEVICE FOR LINKING PNUEMATICALLY-ACTUATED TARGETS

BACKGROUND

Most control devices for target actuation use electricity and, therefore, may be subject to power supply limitations, shock hazard, electronic component failure, and special protection for inclement weather. There are no prior art devices known to the applicant which provide simple time-delaying control and variable speed adjustment with a visual pressure gauge in a compact, portable, and weather proof enclosure which can be installed in line, singly or in multiples, for pneumatically-actuated target systems.

SUMMARY

It is an object of the present invention to provide a control device for pneumatically-actuated target systems comprising:

(a) a compact and portable embodiment which can be installed directly in a pneumatic pressure line;

(b) the means for providing, through the embodiment referenced in (a) above, the delaying of the flow of pressure in the pneumatic pressure line in which said embodiment is installed;

(c) the means for providing, through the embodiment described in (a) above, the temporary directing of air pressure through an additional set of pressure lines to activate and deactivate a pneumatic target system;

(d) the means of controlling, through a wide range of adjustments, the length of the time delay for the pressure flow referenced in (b) above;

(e) the means of controlling, through a wide range of adjustments, the length of time between which the pneumatic target system referenced in (c) above is activated and deactivated; and (f) a simple adjustment system implementing a visual pressure gauge for the controls referenced in (d) and (e) above.

DESCRIPTION OF THE PREFERRED EMBODIMENT

Referring to the accompanying drawings, there is illustrated a preferred embodiment of the control device for linking pneumatically-actuated targets according to the present invention.

Figure 1:
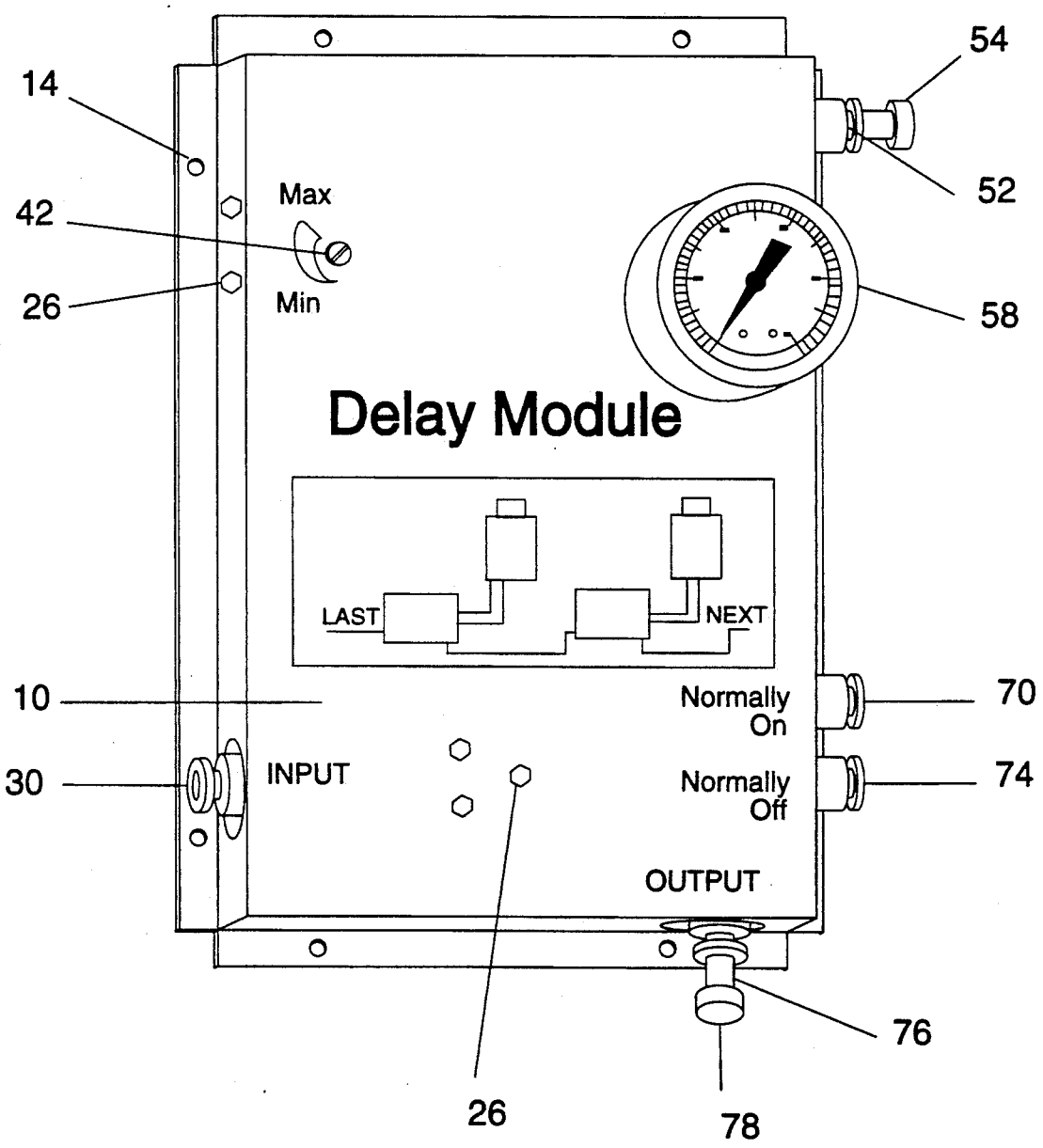
FIG. 1 shows a front angle of an embodiment of the control device for linking pneumatically-actuated targets in accordance with the present invention.
Figure 2:
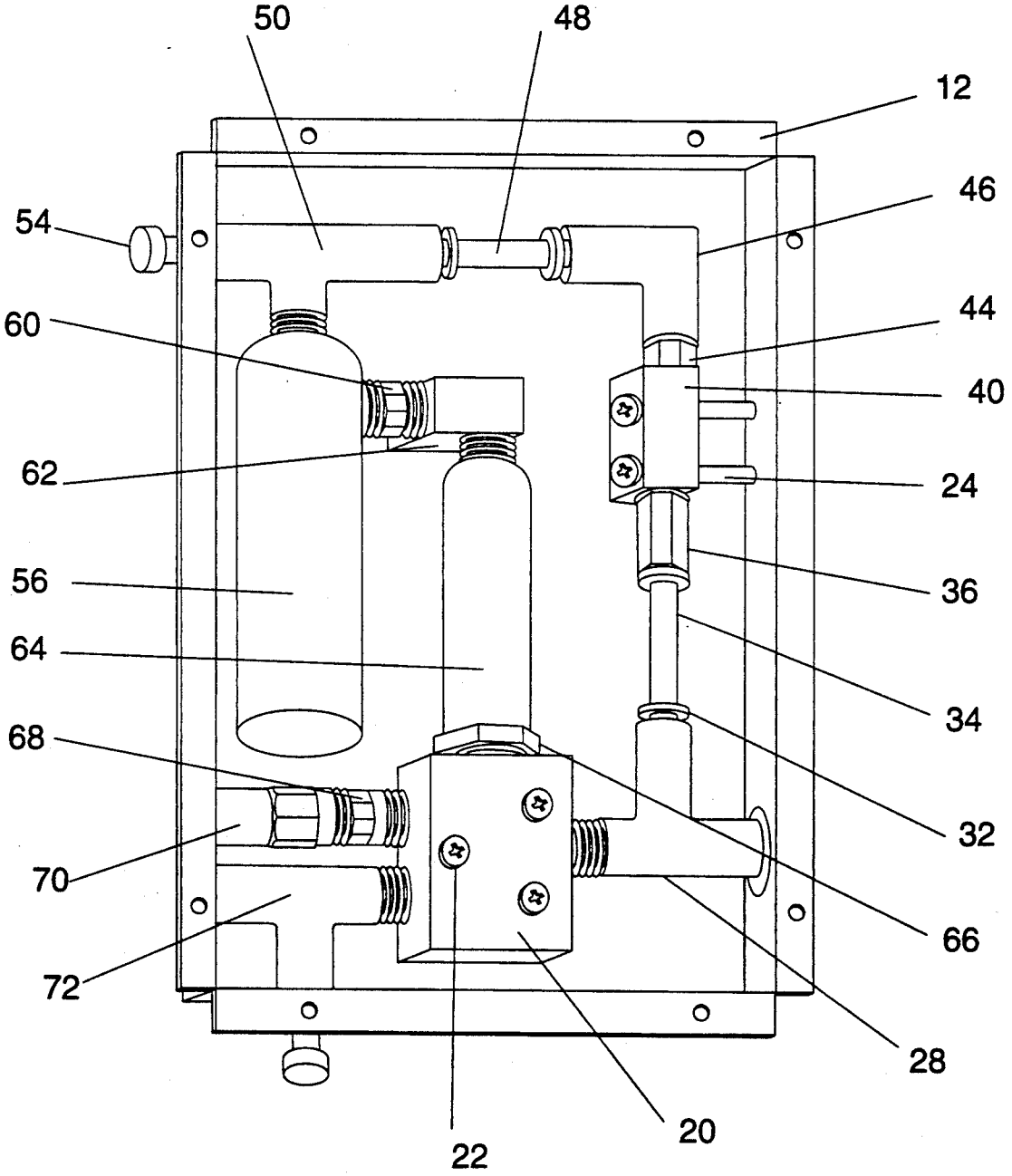
FIG. 2 shows a back angle of the embodiment of the control device for linking pneumatically-actuated targets in accordance with the present invention.

The enclosure (10) is basically a molded box, preferably comprised of brushed aluminum, with the edges (12) bent out perpendicular to the sides of the enclosure. These edges (12) have holes (14) punched in them to provide a simple means for mounting a back cover plate (not shown) which is also preferably comprised of brushed aluminum. A number of holes are punched in the enclosure (10) to accommodate the mounting and exposure of the various operating components of the control device. The front of the enclosure, as illustrated in FIG. 1, preferably has information concerning the connection to and the operation of the control device, including a instruction diagram (16).

A 4-way air switch (20) and a delay control flow adjuster (40) are mounted to the enclosure (10) by means of bolts (22) which pass through these components, then through spacers (24) and are attached to nuts (26) which are set flush with the exterior of the enclosure (10). Other components, a number of which protrude through holes in the enclosure, are supported by these mounted items. A number of alternative methods for mounting the components to this present invention could be devised and those illustrated are only as used in the preferred embodiment.

Threaded into the 4-way air switch (20) is the input "T"-connection (28) which has an air supply input (30) for attachment to a standard ¼-inch pressurized air line and an additional line attachment (32) which connects to a piece of flexible ¼-inch hose (34). The flexible hose (34) also connects to an adapter connection (36) which is threaded into the delay control flow adjuster (40), the delay setting control knob (42) of which protrudes through the front of the enclosure (10).

The delay control flow adjuster (40) is attached to the "L"-connection (46) by means of a threading end (44) which is a part of the "L"-connection (46). This "L"-connection attaches to another piece of flexible ¼-inch hose (48) which connects to the extension "T"-connection (50). The extension "T"-connection (50) has a extension manifold port (52) which can be connected to flexible ¼-inch hose. In the illustrations provided, the extension manifold port (52) is closed by a plug (54). The extension "T"-connection also threads into the accumulation manifold (56).

The accumulation manifold (56) is preferably a fabricated metal chamber which has attached through the enclosure (10) a pressure indicator (58). The accumulation manifold (56) is also connected by means of a double threaded connector (60) to a pilot "L"-connection (62) which threads into the air pilot operator (64).

The air pilot operator (64) attaches to the drive connection (66) which connects to the 4-way air switch (20). Threaded into the 4-way air switch is a double threaded connector (68) which attaches to the upper target control output (70). Also threaded into the 4-way air switch (20) is the output "T"-connection (72) which provides the lower target control output (74) and the air supply output connection (76), both of which connect to standard ¼-inch flexible hose. In the illustrations provided, the air supply output connection (76) is closed by a plug (78).

The following numbered items: 20, 28, 36, 40, 44, 46, 50, 60, 62, 64, 66, 68, 70, and 72 are preferably commercially available brass components and fittings used for pneumatic applications. Some of the other components may be obtained commercially and some require fabrication.

The operation of the preferred embodiment of this present invention is basically as follows: Air control lines for a pneumatic target system are connected to the target control outputs (70 and 74) according to the instructions on the face of the enclosure (10). An air supply line is connected to the air supply input (30). If desired, another air line is connected to the air supply output connection (76) for operation of an additional control device or target system. When air pressure is delivered to the air supply input (30), it immediately passes through the input "T"-connection (28) into the 4-way air switch (20) and out the upper target control output (70) which activates the connected target system.

The air which passes into the input "T"-connection (28) also flows upward through the delay control flow adjuster (40). This component can be adjusted by means of the delay setting control knob (42) to control the speed at which the air pressure flows through the next series of connections into the accumulation manifold (56). The accumulation manifold is also designed to delay the build up of sufficient air pressure necessary to activate the connected air pilot operator (64).

When enough air pressure is accumulated, the air pilot operator (64) engages an internal mechanism through the drive connection (66) to switch the 4-way air switch (20) in such a manner as to stop the flow of air pressure to the upper target control output (70) and re-direct the air flow to the lower target control output (74) and the air supply output connection (76). This action deactivates the connected target system and allows the air supply to be directed to another control device or to an additional target system.

The time interval between the activation and deactivation of the connected target system is basically controlled by the delay setting control knob (42) of the delay control flow adjuster (40). The pressure indicator (58) allows the user to visually watch the measurement of the accumulation and release of pressure, which helps make time control adjustments easy to determine.

In the event the user wants a longer delay between target activation and deactivation, an additional air line may be connected to the extension manifold port and attached to an additional air chamber. This would further delay the buildup of sufficient pressure to activate the air pilot operator, slowing the deactivation of the attached target system.

In application, this control device permits a series of pneumatic targets to be operated in sequence. Each device acts as a time delay. When a device first receives air pressure at its input, it immediately activates the target system it controls. After a period of time, which is set using the adjustment control on the front of its enclosure, the target system is deactivated and air pressure is directed to its output port. This output can be connected to the input of a second device. The second device's output can be connected to the input of a third. And, thus, this linking process can be continued as often as desired.

It is understood that the present invention in not limited to the preferred embodiment presented or the variations thereof described but is susceptible to a number of modifications as are apparent to one skilled in the art. I do not, therefore, wish to limit the present invention to the details shown and described herein, but do intend to cover all modifications which are obvious to one skilled in the art.

The embodiments of the invention in which an exclusive property or privilege is claimed are defined as follows:

1. A control device for pneumatically-actuated target systems comprising:

(a) a control means adapted to be installed directly in a pneumatic pressure line;

(b) delay means within the control means for providing the delaying of the flow of pressure in the pneumatic pressure line;

(c) a set of pressure lines within the control means;

(d) means for providing the temporary directing of air pressure through said set of pressure lines to activate and deactivate a pneumatic target system;

(e) means for varying the length of the time delay for the pressure flow in said delay means;

(f) means for controlling the length of time between which said pneumatic target system is activated and deactivated;

(g) a visual pressure gauge; and (h) an adjustment system for implementing said visual pressure gauge for displaying results of the varying means and time controlling means.

2. A device according to claim 1 including means for varying the speed control for the activation and deactivation of connected target systems through said delay means.

3. A device according to claim 2 including means wherein speed control can be adjusted through use of said visual pressure gauge.

4. A device according to claim 3 including means which, when connected in multiples, can automatically control a series of pneumatic target systems using only one air supply source.

* * * * *